United States Patent [19]

Young

[11] 4,157,157

[45] Jun. 5, 1979

[54] INTERNAL PARTITION

[75] Inventor: Harry E. Young, Houston, Tex.

[73] Assignee: Container Corporation of America, Chicago, Ill.

[21] Appl. No.: 930,929

[22] Filed: Aug. 4, 1978

[51] Int. Cl.[2] ..... B65D 5/48

[52] U.S. Cl. ..... 229/28 R; 229/15

[58] Field of Search ..... 229/15, 42, 27, 28

[56] References Cited

U.S. PATENT DOCUMENTS

| | | | |
|---|---|---|---|
| 2,738,917 | 3/1956 | Mader | 229/15 X |
| 2,860,825 | 11/1958 | Montgomery et al. | 229/42 |
| 3,236,433 | 2/1966 | Barrett et al. | 229/15 |
| 3,519,191 | 7/1970 | Royce | 229/15 X |
| 3,945,557 | 3/1976 | Graham, Jr. | 229/15 |
| 3,963,169 | 6/1976 | Gardner | 229/28 R |
| 4,030,659 | 6/1977 | Gardner | 229/15 |

*Primary Examiner*—Davis T. Moorhead

*Attorney, Agent, or Firm*—Carpenter & Ostis

[57] ABSTRACT

A one-piece paperboard internal partition structure including a center horizontal wall and intersecting pairs of longitudinal and transverse vertical walls disposed on opposite sides of the horizontal wall.

5 Claims, 2 Drawing Figures

INTERNAL PARTITION

SUMMARY OF THE INVENTION

This invention relates to internal partition structures of the type used within an outer container or wrapping.

The invention is concerned primarily with a one-piece, eight cell, paperboard partition structure.

It is an object of the invention to provide, in a partition structure of the type described, a horizontal wall and transversely and longitudinally extending vertical walls disposed above and below the horizontal wall.

These and other objects of the invention will be apparent from an examination of the following description and drawings.

THE DRAWINGS

Figure 1:
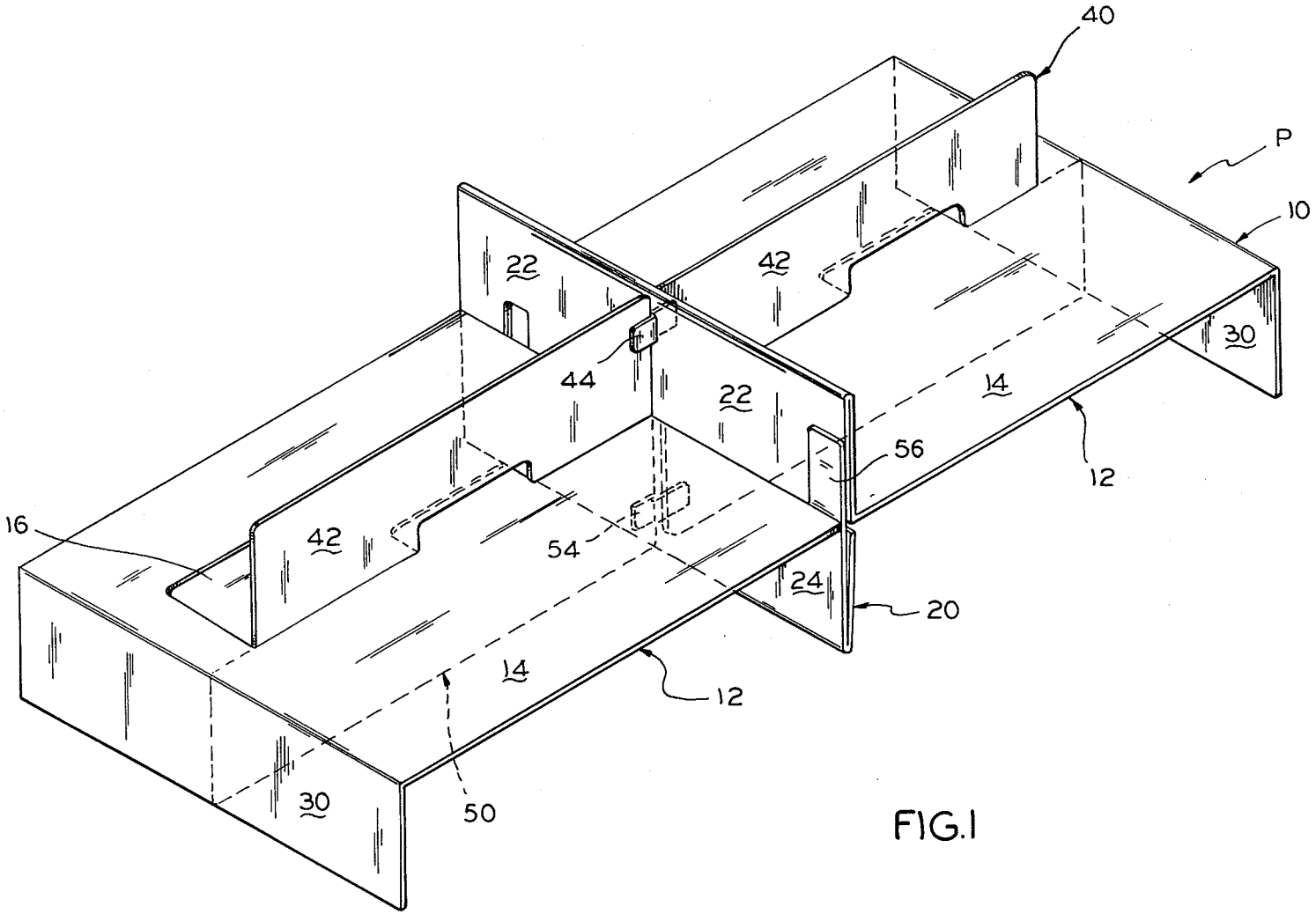
Figure 2:
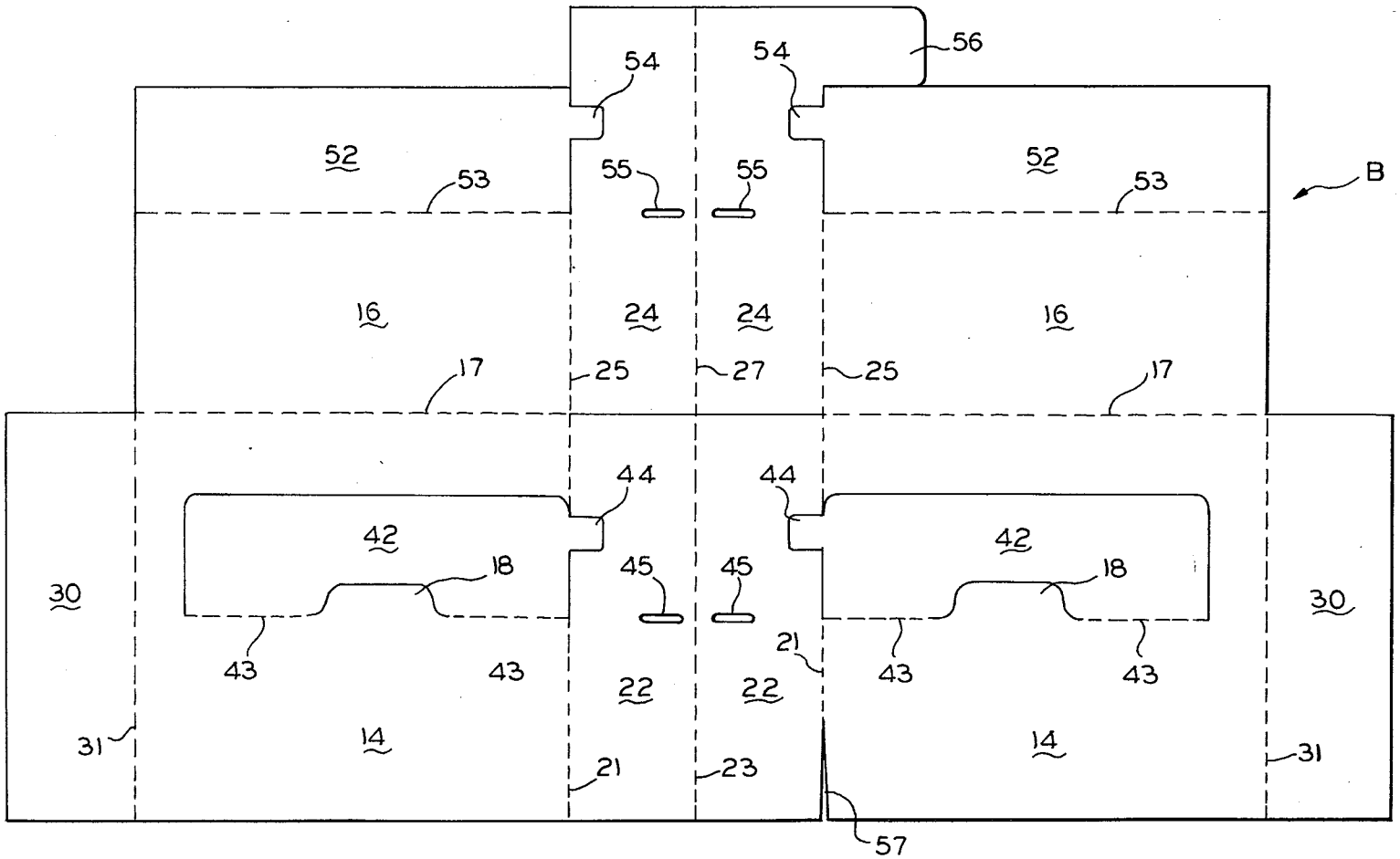

FIG. 1 is a perspective view of a fully erected partition structure embodying features of the invention; and FIG. 2 is a plan view of a blank of foldable sheet material from which the structure illustrated in FIG. 1 may be formed.

It will be understood that, for purposes of clarity, certain elements may have been intentionally omitted from certain views where they are believed to be illustrated to better advantage in other views.

THE DESCRIPTION

Referring now to the drawings for a better understanding of the invention, it will be seen that the novel partition structure embodying features of the invention and indicated generally at P in FIG. 1, may be formed from a unitary blank B of foldable sheet material illustrated in FIG. 2.

As best seen in FIG. 1, the structure includes a horizontally disposed base or horizontal wall 10 which is generally rectangular in shape, and which is comprised of a pair of generally similar co-planar sections 12 disposed in end-to-end relationship on opposite sides of a transversely extending vertical wall 20.

Each of the sections 12 includes an upper panel 14 which preferably extends over the entire area of the section 12 and a somewhat smaller lower panel 16 which is approximately slightly greater than one-half the width of the upper panel. Upper and lower panels 14 and 16 are disposed in face-to-face relation and are foldably joined to each other at common edges along a fold line 17.

The transversely extending center wall 20 includes a pair of upper panels 22 and a pair of lower panels 24 which are disposed in vertical alignment with each other on opposite sides of horizontal wall 10, approximately midway between opposite ends of horizontal wall 10.

Upper panels 22 are disposed in face-to-face relation with each other with their inner or lower edges being foldably joined along fold lines 21 to adjacent inboard edges of related horizontal wall upper panels 14, and have their outer or upper edges foldably joined to each other along a fold line 23.

Likewise, lower panels 24 are disposed in face-to-face relation with their upper or inner edges foldably joined along fold lines 25 to adjacent inboard edges of related horizontal wall lower panels 16, and have their outer or lower edges foldably joined to each other along a fold line 27.

A pair of lower transverse vertical end walls 30 are foldably joined along fold lines 31 to opposed end edges of horizontal wall 10 and extend downwardly from the horizontal wall at right angles thereto.

Additionally, the structure includes an opposed pair of upper and lower longitudinally extending vertical walls 40 and 50 respectively, which are disposed in vertical alignment with each other on opposite sides of horizontal wall 10 approximately midway between the sides thereof.

Upper longitudinal vertical wall 40 includes a pair of panels 42 which are cut from material of the horizontal wall upper panels 14 and which are folded upwardly from horizontal wall 10 at right angles thereto, so as to be positioned in end-to-end relationship on opposite sides of vertical center transverse wall 20. Panels 42 are foldably joined at their inner or lower edges along fold lines 43 to related horizontal wall upper panels 14. Additionally, at their inboard ends, each of the panels 42 is provided with a projection or tab 44 which is received within related apertures 45 in transverse vertical wall upper panels 22 to maintain them in position and afford additional structural rigidity.

Lower longitudinal vertical wall 50 also includes a pair of panels 52 which are foldably joined at their inner or upper edges along fold lines 53 to related inner edges of related horizontal wall lower panels 16. Each of the panels 52 is also provided at its inboard end with an extension or projection 54 which is received within related apertures 55 in vertical wall lower panels 52.

If desired, one of the vertical wall lower panels 52 may be provided with an upwardly extending projection 56 which is adapted to lie in face-to-face relation with a related upper panel 42 and be received within a slot 57 of related horizontal wall upper panel 14.

In erecting the structure, the respective panels 22 and 24 of the upper and lower portions of the vertical wall 20 are folded in face-to-face relation about fold lines 21, 23, 25 and 27, respectively, and then the lower panels 16 of horizontal wall 10 are folded 180° about fold lines 17, so as to underlie upper panels 14 in face-to-face relation therewith. Longitudinal vertical wall upper and lower panels 42 and 52 are then folded outwardly from their respective horizontal wall panels with their tabs 44 and 54 being inserted in related apertures 45 and 55 respectively. At the same time transverse end walls 30 are folded downwardly about related fold lines 31.

Thus it will be appreciated that the unique one-piece structure provides a rigid partition arrangement which affords maximum protection for packaged articles with a minimum amount of material required to form the structure.

I claim:

1. An internal partition formed from a unitary blank of foldable paperboard comprising:

(a) a horizontal wall having a pair of generally similar co-planar sections disposed in end-to-end relation and each including a pair of upper and lower panels foldably joined to each other along common side edges and folded in face-to-face relation;

(b) a transversely extending vertical wall disposed between said horizontal wall sections and having a pair of generally similar co-planar upper and lower sections each including a pair of panels disposed in face-to-face relation with outer edges foldably joined to each other and with inner edges foldably joined to adjacent edges of related horizontal wall panels;

(c) a pair of longitudinally extending upper and lower vertical walls located on opposite sides and centrally of said horizontal wall and each including a pair of panels disposed in end-to-end relation with each panel of each pair being foldably joined at an inner edge to an adjacent edge of a related panel of said horizontal wall.

2. A partition according to claim 1, and including an opposed pair of transverse, vertical end walls foldably joined at their upper edges to related end edges of said horizontal wall and extending downwardly from said horizontal wall and normal thereto.

3. A partition according to claim 1, wherein each of said horizontal wall section upper panels is substantially coextensive with said section and wherein each of said horizontal wall section lower panels has a width of approximately one-half of its related upper panel.

4. A partition according to claim 1, wherein the panels of one of said longitudinal vertical walls each extend from an end of said horizontal wall to said transverse vertical wall.

5. A partition according to claim 1, wherein the panels of one of said longitudinal vertical walls is cut from material of the horizontal wall panel to which it is foldably joined.

* * * * *